US005573226A

United States Patent [19]

Smith

[11] Patent Number: 5,573,226

[45] Date of Patent: Nov. 12, 1996

[54] APPARATUS FOR GUIDING AN ENLOGATED ITEM

[76] Inventor: Jackson A. Smith, P.O. Box 1058 Aldergrove, British Columbia, Canada, V0X 1A0

[21] Appl. No.: 235,175

[22] Filed: Apr. 29, 1994

[51] Int. Cl.[6] ..... B66D 3/08; B65H 59/00; B65H 57/00; B65H 23/04

[52] U.S. Cl. ..... 254/395; 226/196; 242/157 R; 242/615.3; 254/134.3 PA; 254/400; 254/402; 254/409

[58] Field of Search ..... 242/157 R, 615.2, 242/615.3, 566, 129; 254/395, 396, 400, 401, 402, 404, 134.3 PA, 409, 415, 412; 226/196

[56] References Cited

U.S. PATENT DOCUMENTS

| | | | |
|---|---|---|---|
| 522,524 | 7/1894 | Hook | 254/395 X |
| 1,525,837 | 2/1925 | Walker et al. . | |
| 2,422,353 | 6/1947 | Hitt . | |
| 2,483,760 | 10/1949 | Duncan . | |
| 2,783,025 | 2/1957 | Scheidt . | |
| 2,816,734 | 12/1957 | Crofoot | 242/157 R |
| 2,946,559 | 7/1960 | Pickett | 254/395 X |
| 3,070,355 | 12/1962 | Wyatt . | |
| 3,130,958 | 4/1964 | McAuley | 254/134.3 PA |
| 3,300,191 | 1/1967 | Leigh | 254/395 |
| 3,407,011 | 10/1968 | Zeidler | 254/395 X |
| 3,545,724 | 12/1970 | Wright | 254/134.3 PA |
| 3,918,685 | 11/1975 | Lindsey et al. | 254/415 X |
| 4,479,453 | 10/1984 | Bonassi | 254/395 X |
| 4,721,285 | 1/1988 | McMichael . | |
| 5,149,059 | 9/1992 | Monahan | 254/415 X |

*Primary Examiner*—Michael R. Mansen
*Attorney, Agent, or Firm*—Seed and Berry LLP

[57] ABSTRACT

An apparatus for guiding elongated items, such as cables, wires, hoses, and the like, onto or from spools. The apparatus includes two frame members that are pivotally and hand-releasably connected together to form an enclosed frame through which the elongated items are guided. A first pivotal and hand releasable connection is made between a first leg of the first frame member and a first leg of the second frame member. A second pivotal and hand-releasable connection is made between second legs of the frame members to provide a releasable opening of the enclosed frame. The releasable opening provides access to the enclosed frame for installation of the elongated item without requiring access to one of the ends of the elongated item to thread it through the enclosed frame. One of the frame members also includes provision for attachment to a mount, by which the enclosed frame is held in any of a plurality of selectable positions with respect to the mount.

30 Claims, 5 Drawing Sheets

APPARATUS FOR GUIDING AN ENLOGATED ITEM

TECHNICAL FIELD

The present invention relates to a portable apparatus for guiding elongated items such as cables, wires, hoses, and the like onto or from spools.

BACKGROUND OF THE INVENTION

Guiding devices have long been used for spooling and unspooling elongated items. One use for these devices is for the installation of telephone, power, and fiber optic cables. There may be upwards of 25 reels of cable brought to a site on a truck, and each of these reels conventionally feeds a single guiding device through which cables of different diameters and fragilities must pass together. Because of this, there is significant opportunity for entanglement and damage to fragile cables such as fiber optic cables. In addition, often each cable is laid by a different worker, such that each worker's efforts can be disruptive to the efforts of the other workers when all simultaneously share a single guiding device.

One reason that a single guiding device is conventionally used is that such prior art devices are difficult to move into position and difficult to mount into optimal positions and dispositions with respect to the spools of cable. Also, such devices are heavy and bulky, so that repositioning in the field is often not practical.

Some prior art devices include guide rollers that are not designed to overcome the problem of guiding and protecting delicate elongated items, such as fiber optic cables. Prior art devices do not include any mount scheme that allows the guiding devices to be flexibly employed in a plurality of different positions with respect to the spools and the work being done with the cables. The bulk, heft, and relatively inflexible mounting schemes of prior art devices are not convenient to a strategy of utilizing a separate and appropriately sized guiding device for each individual cable being used by various workers.

Another difficulty with prior art devices is that such devices often lack a means by which a cable can be placed within their enclosure and against their guiding surfaces without resort to threading a free end of the cable through the guiding devices. For example, Scheidt U.S. Pat. No. 2,783,025 discloses a permanently mounted cable guiding apparatus. Such permanently fixed devices do not work well when their application cannot be determined in advance or when that application is subject to change as is common when stringing or laying cable. Further, the device disclosed in the Scheidt patent does not include a means by which cable can be installed in the device without resort to threading one of the cable ends through the device.

Another prior art device can be found in Wyatt U.S. Pat. No. 3,070,355 which discloses an enclosed guide frame having a single leg that pivots open. There are at least two problems with the frame design shown in the Wyatt patent. First, the pivoting leg is secured with a heavy screw that requires a wrench to open. Second, only a single leg of the frame opens to form a relatively narrow entrance into the enclosed frame, such that it can be relatively difficult to insert a cable into the frame. Further, the Wyatt patent fails to disclose a mounting scheme for a guide frame that is adapted to place the guide frame in any of a plurality of positions with respect to the mount.

For the foregoing reasons there is a need for a guiding apparatus that provides for quick and easy access to its guiding enclosure and a maximal enclosure opening width, and that is constructed specifically for manufacturing economy, portable operation and maximum flexibility.

SUMMARY OF THE INVENTION

Accordingly, it is an object of the present invention to provide a guiding apparatus having a guiding enclosure with a quick, releasable access. It is a further object of the invention to provide a maximally-sized access opening to the guiding enclosure. It is another object of the invention to employ a structure that lends itself to lightweight fabrication, as well as to economy of fabrication by providing for part symmetry. It is yet another object of the invention to employ a structure that lends itself to protection of the elongated items being guided. It is yet another object of the invention to employ a structure that flexibly permits attachment to a work piece in a plurality of positions with respect to the work piece.

The foregoing and other objects are met by an apparatus for guiding an elongated item according to a preferred embodiment of the present invention. The guide apparatus includes a frame with a guiding surface for guiding the elongated item through the frame. The frame includes a first frame member pivotally coupled to a second frame member. A hand-releasable pin releasably extends through a connecting aperture in the first frame member and into a latching aperture in the second frame member to latch the frame. The pin easily slides through the connection aperture and into the latching aperture to allow hand-removal of the pin to open the frame. The frame further includes a frame coupling, and the apparatus further includes a mount having a mating coupling means for connecting the mount to the frame coupling and to place the frame in any of a plurality of positions with respect to the mount.

DESCRIPTION OF THE PREFERRED EMBODIMENTS

A preferred embodiment of the present invention is directed to an apparatus for guiding an elongated item, which includes a frame with a guiding surface for guiding the elongated item through the frame. The frame includes a first frame member pivotally coupled to a second frame member. A hand-releasable pin releasably extends through a connecting aperture in the first frame member and into a latching aperture in the second frame member to latch the frame. The pin easily slides through the connection aperture and into the latching aperture to allow hand-removal of the pin to open the frame. The frame further includes a frame coupling, and the apparatus further includes a mount having a mating coupling means for connecting the mount to the frame coupling and to place the frame in any of a plurality of positions with respect to the mount.

Figure 1:
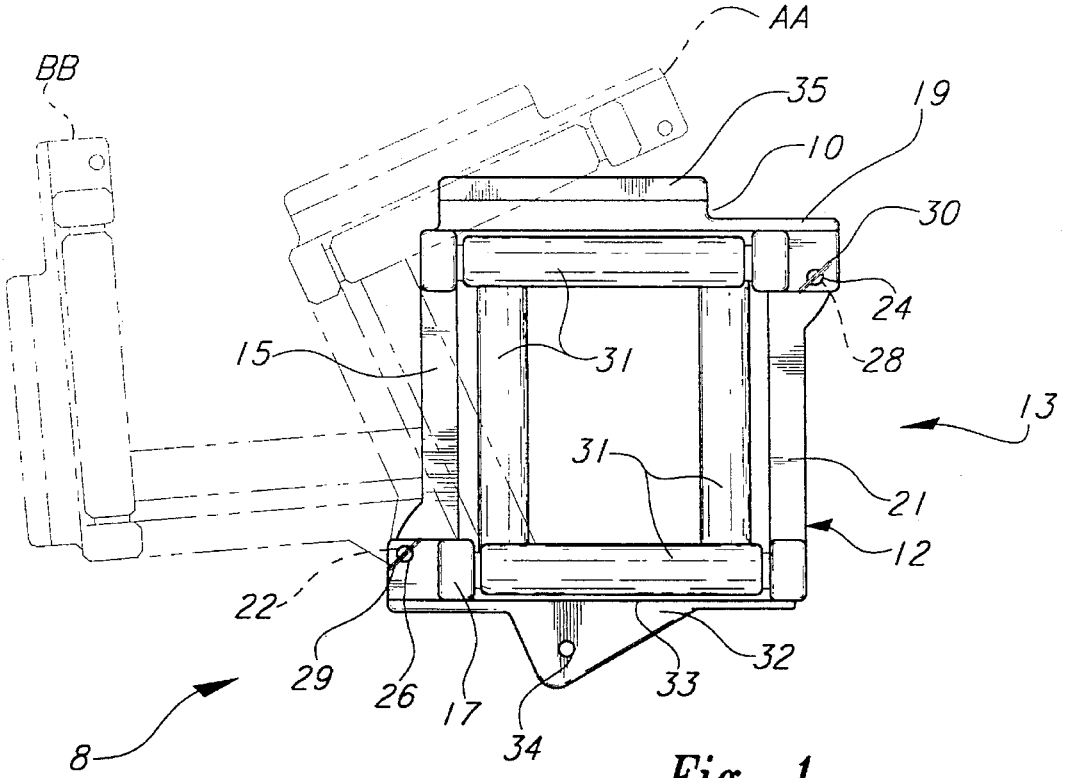
FIG. 1 is a front elevational view of one embodiment of the guiding apparatus embodying teachings of the present invention.

With reference to FIG. 1, a preferred embodiment of the invention is directed to a guiding apparatus 8 including a first frame member 10 coupled to a second frame member 12 to form an enclosed frame 13 through which a cable is guided. The first frame member 10 has a first leg 15 pivotally coupled to a first leg 17 of the second frame member 12, as described below. The first frame member also includes a second leg 19 hand-releasably latched to a second leg 21 of the second frame member 12 to allow the enclosed frame 13 to pivot open when unlatched. Preferably, each first leg is connected to its associated second leg at substantially a right angle. The first and second frame members preferably are structurally equivalent so that they can be of molded construction and share the same mold for manufacturing economy. However, such equivalence or symmetry is not necessary for the structure or operation of the apparatus.

The first frame member 10 includes a pivot hole 22 in its first leg member 15 and a latch hole 24 in its second leg member 19. Likewise, the second frame member 12 includes a pivot hole 26 in its first leg 17 and a latch hole 28 in its second leg 21. A hand-releasable pivot pin 29 extends through the pivot holes to pivotally connect the first frame member 10 to the second frame member 12. A hand-releasable latch pin 30 extends through the latch holes to releasably latch the first frame member to the second frame member.

When the latch pin 30 is removed from the latch holes 24, 28, the first frame member 10 pivots about the pivot pin 29 to a position AA shown in phantom lines in FIG. 1. Cables can then be inserted into or removed from the frame 13. In addition, when relatively large cables need to be inserted in or removed from the frame 13, the first frame member 10 pivots open to a position BB, also shown in phantom in FIG. 1. To close the frame 13, the first frame member 10 is pivoted back to its original position and the latch pin 30 is inserted through the latch holes 24, 28. Preferably, the roles of the pivot pin and the latch pin can be reversed such that the enclosed frame 13 can be opened by removing the pivot pin 29 to allow the first and second frame members to pivot about the latch pin 30. Both the pivot pin 29 and the latch pin 30 can be straight cylindrical pins, clips or any other suitable members for insertion through the pivot holes 22, 26 and the latch holes 24, 28, respectively (shown circular in the figures though circularity is not necessary).

Each of the first and second frame members 10, 12 rotatably supports a plurality of rollers 31 with the aid of suitable bearings (not shown). The rollers provide guiding surfaces across which the elongated item passes as it is being guided through the enclosed frame 13. Preferably, each frame member supports three rollers, although only two of the rollers 31 supported by each frame member are shown in FIG. 1, the third roller of the first frame member being parallel to and directly behind the horizontal roller 31 showing at the top of FIG. 1, and the third roller of the second frame member being parallel to and directly behind the horizontal roller 31 showing at the bottom of FIG. 1. Alternatively, the invention could be carried out with any number of rollers, including no rollers at all. The rollers of the preferred embodiment include a plastic such as urethane for preventing the surface of delicate fiber-optic cables from being nicked and scratched as they are guided across the rollers. The entire roller can be plastic, or the surface of the roller can be selectively or fully covered or coated with plastic.

The second frame member 12 includes a frame connecting web 32 extending from its first leg 17. The frame connecting web has an outer frame surface 33 and a frame connection hole 34 extending therethrough for connection to a mount as will be described below in connection with FIG. 2. Similarly, the first frame member 10 includes a frame track 35 for connection to an alternate mount as will be described below in connection with FIGS. 3 and 4. Alternatively, the first and second frame members can each include frame tracks or can each include webs to make the first and second frame members structurally equivalent. Such structural equivalence allows the frame members to be of molded construction and share the same mold.

Figure 2:
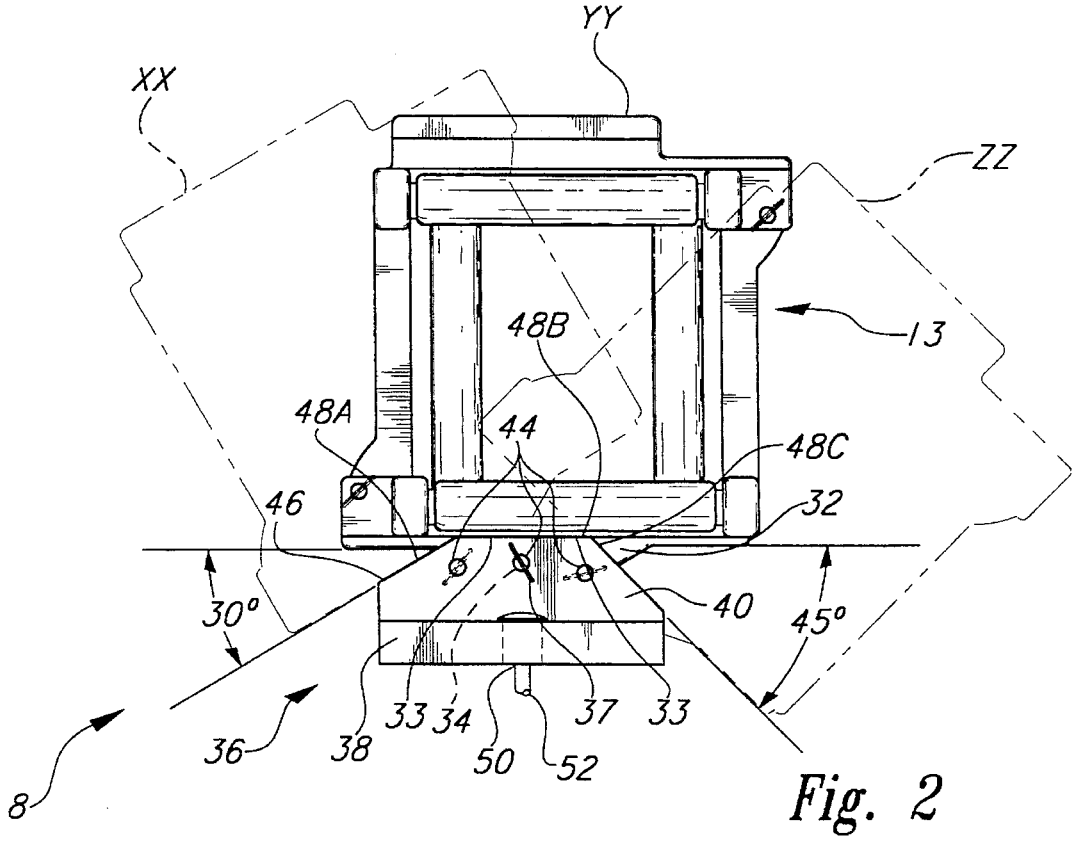
FIG. 2 is a front elevational view of the guiding apparatus shown in FIG. 1, including a guide mount.

With reference to FIG. 2, the guiding apparatus 8 further includes a mount 36, and a hand-releasable mount pin 37 for attaching the frame 13 to the mount. The mount 36 includes a mount base 38 with a first mount web 40 and a second mount web (not shown) projecting upwardly from the base. The second mount web is not visible in FIG. 2 because it is parallel to and directly behind the first mount web 40. Each of the first and second mount webs 40 have a plurality of mount holes 44, the mount holes extending through the first mount web 40 aligning coaxially with the mount holes extending through the second mount web. As such, each mount hole 44 of the first mount web has an associated coaxial mount hole of the second mount web that, taken together, form a hole pair. Any of the hole pairs can be selected by a user to receive the mount pin 37.

The frame connecting web 32 is positioned between the mount webs 40, so that the frame connection hole 34 is coaxial with the selected hole pair of coaxial holes 44. The mount pin 37 extends through the frame connection hole 34 and the selected pair of mount holes 44, to pivotally connect the enclosed frame 13 to the mount 36. Although the use of two mount webs provides one way to enhance the strength and stability of the pivotal connection, it is not necessary that there be a second mount web. Alternatively, the second mount web can be included without a coaxial mount hole, such that the mount pin only extends through the first mount web hole and into the frame connection hole.

Preferably, the mount web 40 includes an outer mount surface 46 presenting a plurality of planar segments 48A–C each forming a different angle with respect to the mount base 38. The planar segments form angles of 30, 0, and 45 degrees, respectively, in a preferred embodiment as shown in FIG. 2. Of course, any number of planar segments may be employed and each planar segment may form any desired angle with respect to the mount base.

The outer frame surface 33 of the second frame member 12 contacts a selected one of the planar segments 48A–C when the frame connecting web is inserted between the mount webs.

When the outer frame surface 33 contacts the first planar surface 48A, the frame is placed in a position xx (shown in phantom lines in FIG. 2), which is at a 30° angle with respect to the mount base 38. Similarly, the frame 13 can be placed in position yy (shown in solid lines) or position zz (shown in phantom lines) by contacting the outer frame surface 33 with planar segments 48B and 48C, respectively.

The contact of the outer frame surface with the selected planar segment releasably prevents rotation of the enclosed frame 13 with respect to the mount 36 when the mount pin 37 is inserted through the mount holes 44 and the frame connection hole 34. Alternatively, the outer mount surface 46 may be curved and still prevent rotation. For example, rotation can be prevented by a employment of any surface shape that has an increasing radius of curvature in the direction of rotational force. Similarly, the outer frame surface 33 may also be curved in a similar manner.

The mount base 38 includes a mounting aperture 50 for receiving a connecting member 52, such as a pin, bolt, or screw, for connection to a work surface, such as a telephone pole or a truck. Alternatively, another fastening mechanism, such as a clamp, weld, or chemical bond, could also be used to fasten the mount.

Figure 3:
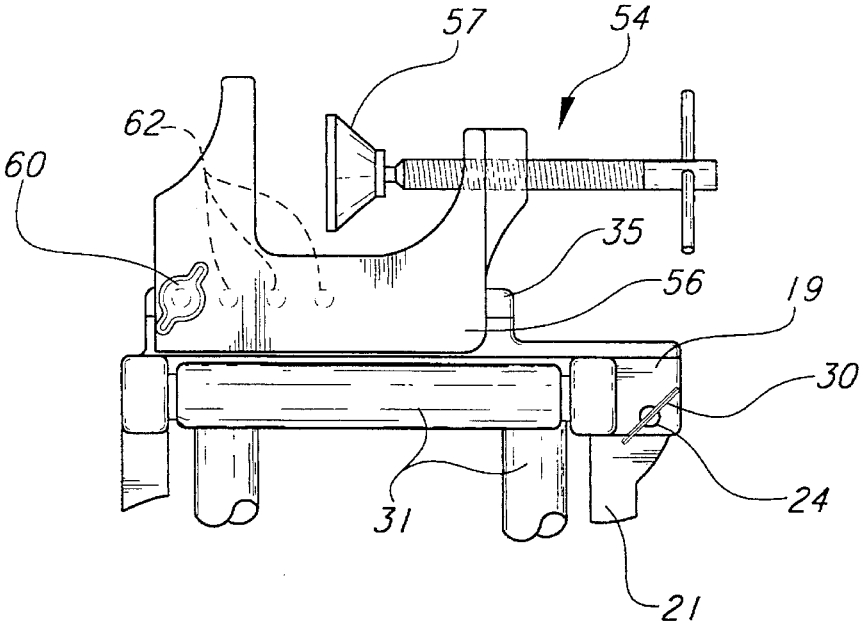
FIG. 3 is a cut-away front elevational view of an alternate embodiment of the present invention.
Figure 4:
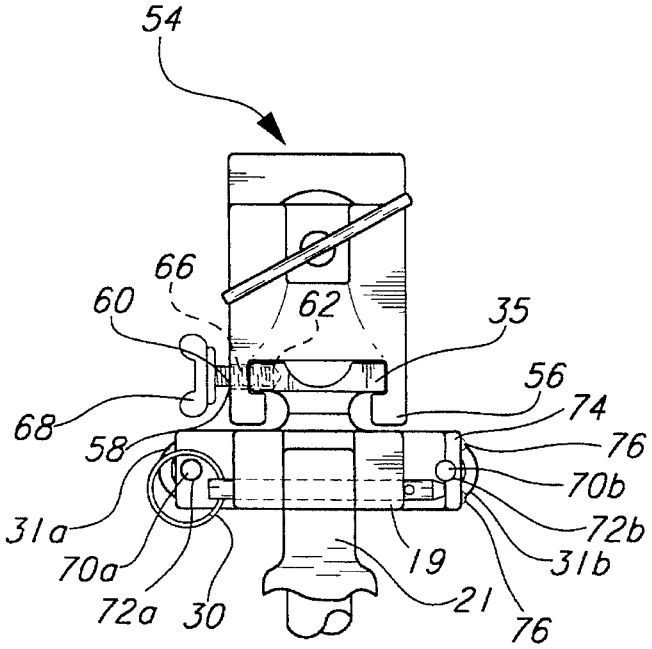
FIG. 4 is a cut-away end view of the apparatus of FIG. 3.

With reference to FIGS. 3 and 4, an embodiment is shown in which the enclosed frame 13 is connected to an alternate mount 54 having a mount track 56 integrally formed therein. The frame track 35 slidably connects to the mount track 56 to allow the frame 13 to be positioned in any of a plurality of positions along the longitudinal extent of the mount track. The mount 56 includes a clamp 57 for connecting the mount 56 and frame 13 to a work surface, such as a telephone pole or a truck.

The mount track 56 includes a threaded mount aperture 58 through which a frame locking member 60 extends to engage the frame track 35. The frame track 35 includes a plurality of clamp apertures 62 that receive the locking member 60 to selectively lock the frame track to the mount track. Preferably, the frame locking member 60 is a hand screw having an end 66 that penetrates and engages a selected one of the clamp apertures 62, thereby restricting movement of the frame track in the mount track. As such, the frame track and mount track allow a user to select any of numerous positions of the frame with respect to the mount and the frame locking member releasably locks the frame in the selected position. The hand screw 60 also includes wings 68 to allow the screw to be engaged and released by hand.

Of course, the engagement of the hand screw 60 in the clamp apertures 62 only illustrates one way of positioning and locking the frame. For example, friction contact exerted by a hand operated cam-over mechanism could also perform the positioning and locking functions.

Shown in FIG. 4 are alternate designs for attaching the rollers 31 to the respective frame members. The first roller 31A includes an axial pin 70A that is press-fit into an aperture 72A in the frame member 19. Press fitting locks the axial pin 70A in place, but the roller 31A is permitted to rotate on the axial pin.

The second roller 31B is coupled to the frame member 19 by an alternate scheme. The second roller 31B includes an axial pivot pin 70B that is placed in an aperture 72B formed between a roller cap 74 and the frame member 19. The roller cap 74 is coupled to the frame member 19 by conventional connectors 76 such as rivets or screws. Preferably the connectors 76 are easily removable screws that allow the roller cap 74 to be detached. Detaching the roller cap 74 allows the pivot pin 70B to be removed from the aperture 72B and allows a differently sized or shaped roller to be used in place of the roller 31B.

Figure 5:
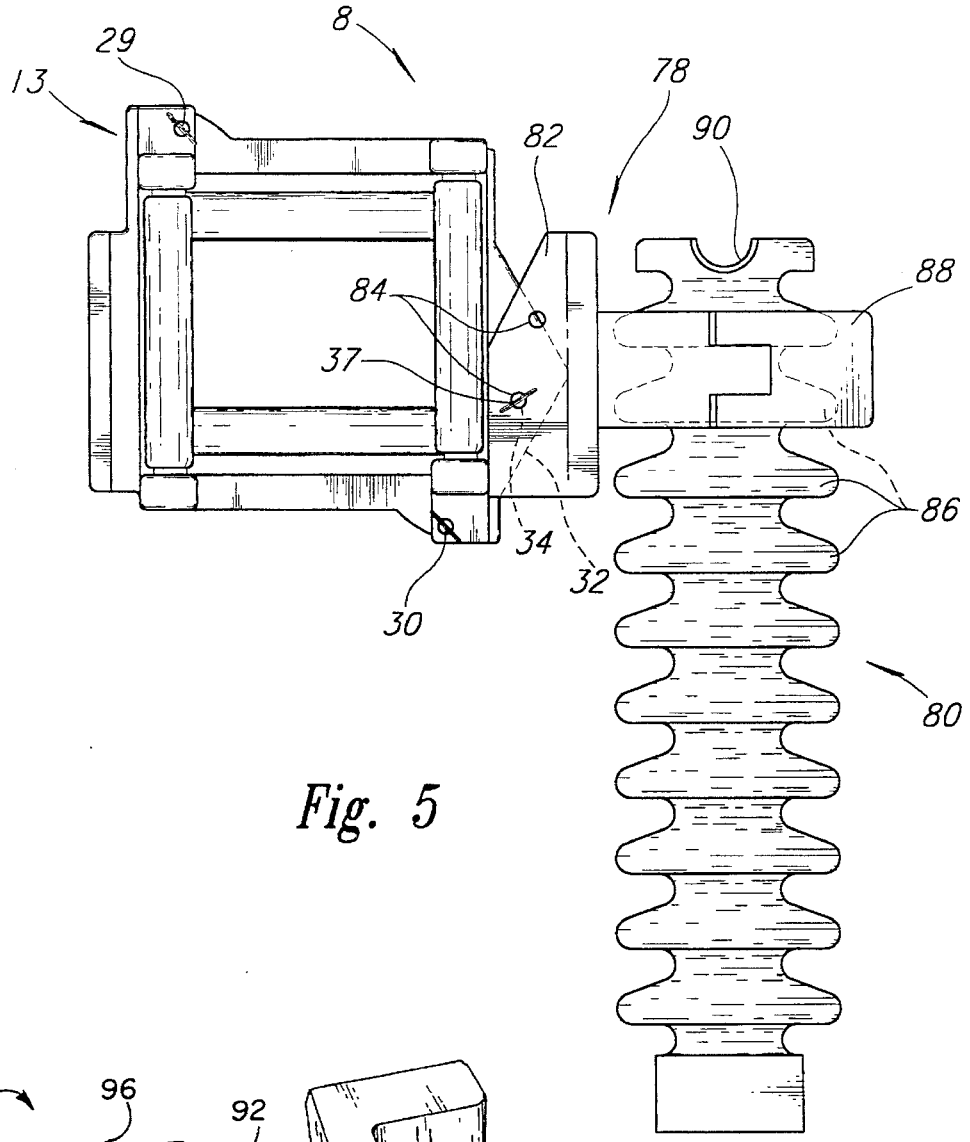
FIG. 5 is a front elevational view of an alternate embodiment of the guiding apparatus of the present invention.

Shown in FIG. 5 is an alternate mount assembly 78 designed to mount the enclosed frame 13 to a conventional insulator collar 80 of a power or telephone pole. The mount assembly 78 includes a mount base 82 with dual connector apertures 84 adapted to match up with the frame connection hole 34 of the frame connection web 32. The mount pin 37 is inserted through the frame connection hole 34 and either of the mount connection holes 84 to removably couple the mount assembly 78 to the enclosed frame 13. Like the mount 36 shown in FIG. 2, the provision of plural connection holes 84 allows the enclosed frame 13 to be positioned in a plurality of angles with respect to the mount base 82.

A typical telephone or power pole has several insulator collars 80 to which the telephone or power cables are attached. Each insulator collar 80 has numerous circumferential flights or sheds 86 extending transversely with respect to the axis of the insulator collar. Extending from the mount base 82 is an insulator clamp 88 that clamps onto the insulator collar 80 and grasps one or more of the flights 86.

Attachment of the telephone or power cable (not shown) to the insulator collar 80 is easily accomplished with the present invention. The guiding apparatus 8 is attached to the insulator collar 80 using the mount assembly 78 while the pole is on the ground or when upright. The cable is guided through the enclosed frame 13 to string the cable from pole to pole. To remove the cable from the enclosed frame, the pivot pin 29 or the latch pin 30 is removed to allow the enclosed frame 13 to pivot open. The cable is then lifted onto the insulator collar 80 and placed in a slot 90 at the top of the insulator collar. The cable is then wired in place on the insulator collar and the guiding apparatus 8 is removed from the insulator collar.

Attaching the guiding apparatus 8 directly to the insulator collar 80 allows the telephone or power cable to be attached to the insulator collar much easier than is the case with prior art guiding apparatuses. Prior art guiding apparatuses mount to the telephone or power pole itself by a heavy chain that wraps around the upright portion of the pole. The upright portion of the pole typically is several feet from the insulator collar, so a special device known as a stringing block is needed to pull the cable over to the insulator collar for attachment thereon. Given that the guiding apparatus 8 of the present invention is mounted directly to the insulator collar, the cable is only a few inches from the insulator collar rather than several feet, so no special stringing block is necessary.

Another problem with the prior art guiding apparatuses is that the attaching chains are held in place on the pole upright by the weight of the guiding apparatus pulling downward on one side of the chain, thereby tightening the chain on the pole upright. As such, the pole must be fully upright for the chain and guiding apparatus to remain fixed on the pole. In contrast, the guiding apparatus 8 of the present invention is clamped directly to the insulator collar 80—a step that can be performed on the ground or in the air.

Figure 6:
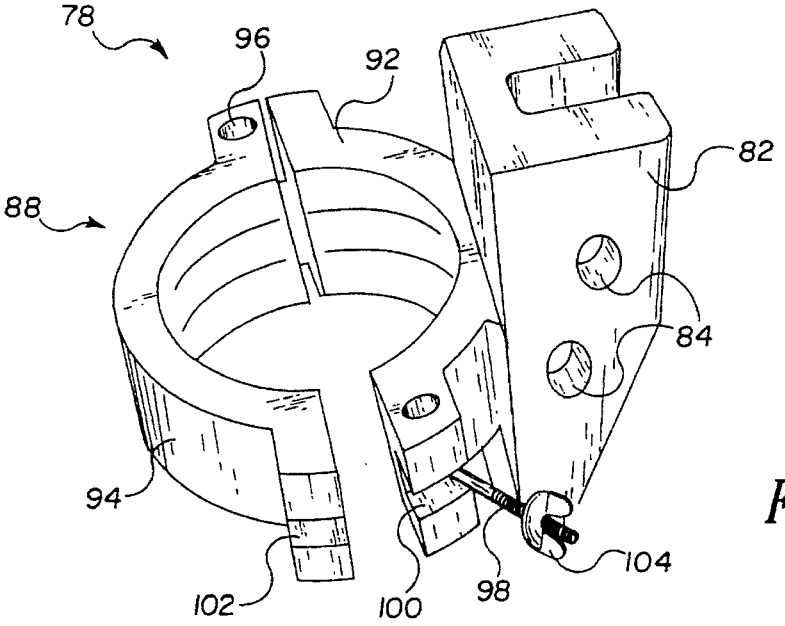
FIG. 6 is an isometric view of a mount assembly of the guiding apparatus shown in FIG. 5.

Shown in FIG. 6 is an elevational view of the mount assembly 78. The insulator clamp 88 includes a first clamp member 92 fixed to the mount base 82. A second clamp member 94 is pivotally connected to the first clamp member 92 via a pivot pin 96. Pivotally attached to the first clamp member 92 is a threaded bolt 98 that pivots within a slot 100 in the first clamp member 92. The clamp bolt 98 pivots into a slot 102 in the second clamp member 94 and a wing nut 104 is screwed onto the clamp bolt 98 to couple together the first and second clamp members. By tightening the wing nut 104 onto the clamp bolt 98, the insulator clamp is tightened onto the insulator collar 80 as shown in FIG. 5.

Figure 7:
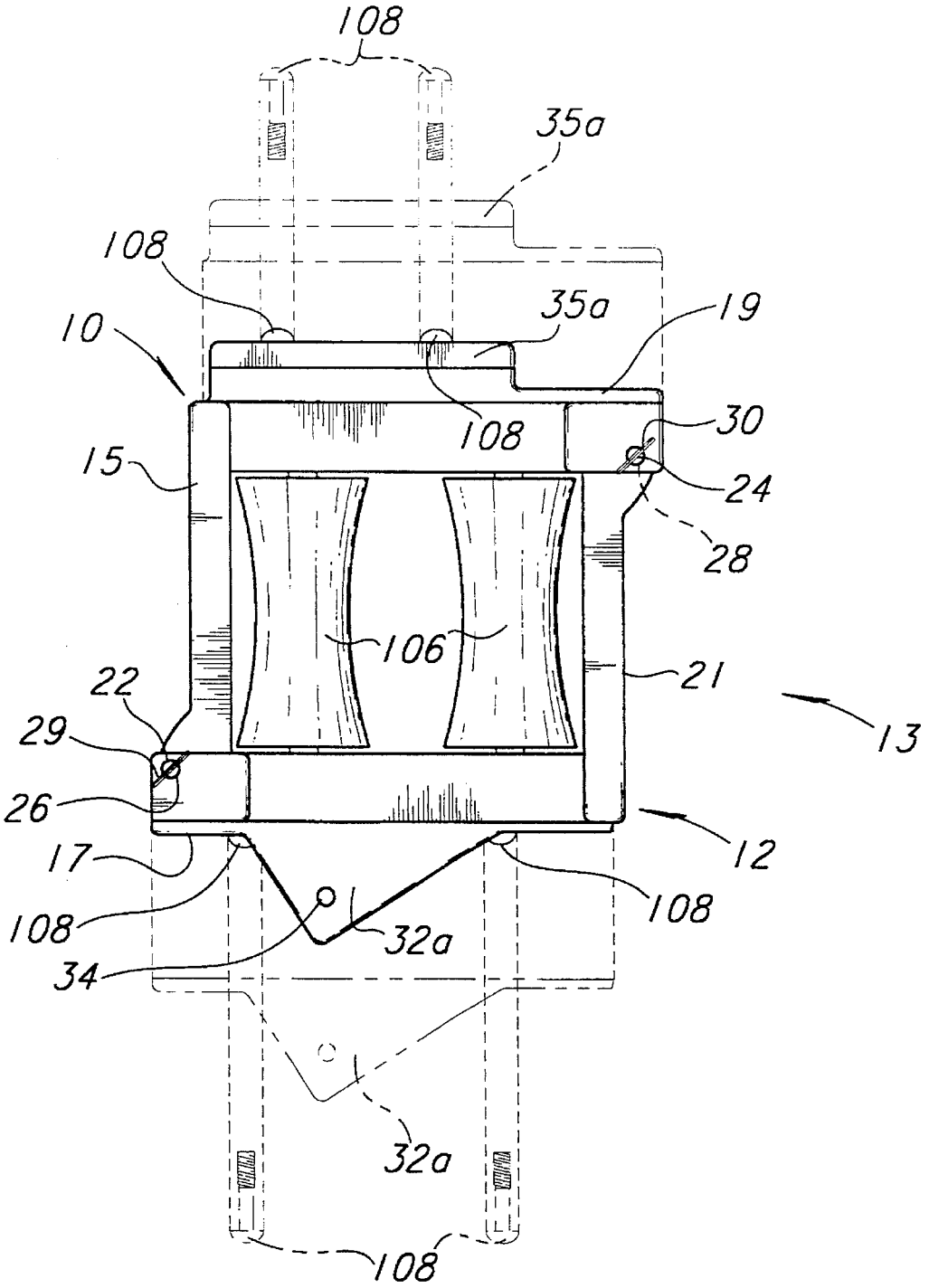
FIG. 7 is a front elevational view of an alternate guiding apparatus according to the present invention.

Shown in FIG. 7 is an alternate embodiment of the enclosed frame 13. In the embodiment of FIG. 7, the six cylindrical rollers 31 shown in FIGS. 1–4 are replaced by two large hourglass-shaped rollers 106. The rollers 106 include concave sides forming an opening through the enclosed frame having a large width toward the center of the rollers and smaller widths at the ends of the rollers. The hourglass shape of the rollers allows cables to fit through the central area of the frame without contacting frame members 10, 12 by sliding past the ends of the rollers.

FIG. 7 also depicts an alternate frame track 35A. In the embodiment shown in FIGS. 1–4, the frame track 35 is integral with and part of the first frame member 10. In the embodiment shown in FIG. 7, the alternate frame track 35A is molded separately from the first frame member 10 and is removably attached to the frame member by conventional connectors 108 such as screws or bolts. Likewise an alternative frame connecting web 32A can be molded separate from the second frame member 12 such that the frame connecting web 32A and the frame track 35A are removable and interchangeable. The removability of the frame connecting web 32A and the frame track 35A provides additional versatility and allows the enclosed frame to be produced more inexpensively.

Figure 8:
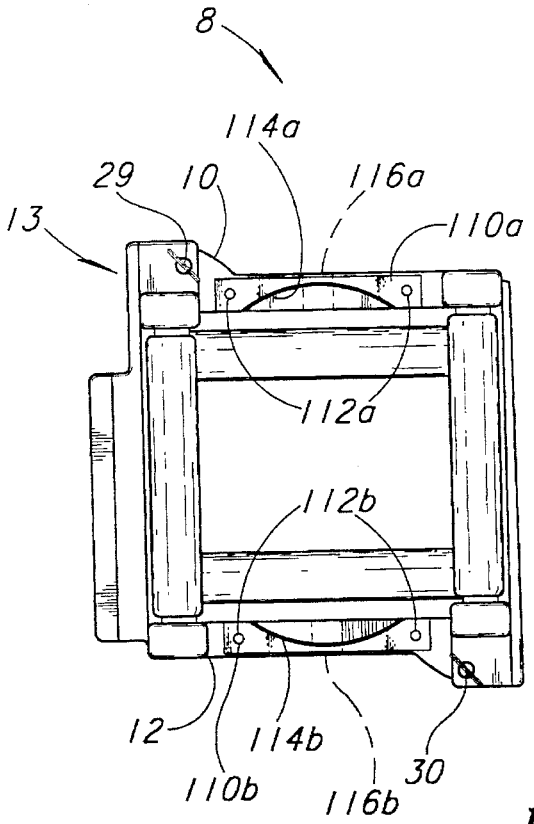
FIG. 8 is a front elevational view of another alternate guiding apparatus according to the present invention.

Shown in FIG. 8 is a guiding apparatus 8 adapted for guiding cables through elongated tubes such as PVC ducts or cable risers in a high rise building. Attached to the first and second frame members 10, 12 of the enclosed frame 13 are a pair of split tube attachments 110A, 110B. The split tube attachments are attached to the frame members by conventional means, such as screws 112A, 112B. Each split tube attachment includes an elongated arcuate surface 114A, 114B sized to extend snugly in the PVC duct or other tube (elongation extends out of the page in FIG. 8). The enclosed frame 13 also includes an injector port 116A, 116B extending through each of the frame members 10, 12 to allow lubricant to be injected into the interior of the enclosed frame.

Figure 9:
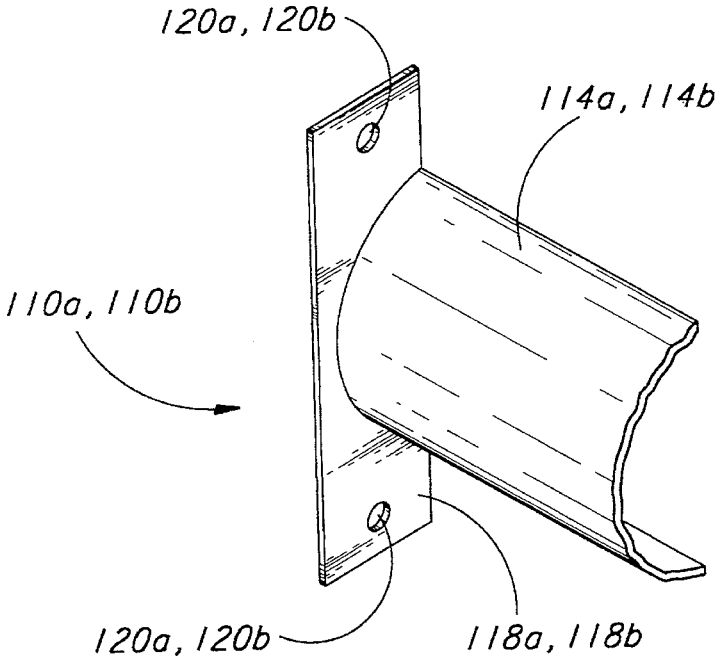
FIG. 9 is an isometric view of a split tube attachment of the guiding apparatus shown in FIG. 8.

Shown in FIG. 9 is an isometric view of one of the split tube attachments 110A, 110B. The elongated arcuate surface 114A, 114B extends from a flange 118A, 118B at one end of the split tube attachment. The flange includes holes 120A, 120B through which the connecting screws 112A, 112B are inserted to attach the split tube attachment to the enclosed frame 13.

In operation, the elongated arcuate surfaces 114A, 114B of the guiding apparatus 8 shown in FIG. 8 are inserted into an open end of the PVC duct or tube. Preferably, the elongated arcuate surfaces fit relatively closely in the PVC duct or tube to restrain lateral movement of the guiding apparatus with respect to the PVC duct or tube. An operator guides a cable through the enclosed frame 13 between the rollers 31 and the elongated arcuate surfaces and into the PVC duct or tube. While guiding the cable through the enclosed frame, the operator forces lubricant through the injector port 116A, 116B onto the cable. By applying lubricant through the injector port onto the cable, reels of cable as long as 5,000 feet are forced through the PVC duct with reduced friction, thereby lowering pulling tension on the cable up to 35%.

The addition of the split tube attachments 110A, 110B and the injector port 116A, 116B provides a guiding apparatus 8 that reduces accidents and the monetary cost of pulling cable. Prior art methods apply lubricant to the cable by hand while the cable is pulled into the PVC duct at very high speed. The operator's hand or arm could easily be drawn into the PVC duct and damaged by the moving cable. In addition, the cable lubricating operation is performed at street level, and often directly adjacent pedestrian walkways. If lubricant is spilled on the pedestrian walkway, severe injury to pedestrians walking on the walkway may occur. By allowing lubricant to be injected directly onto the cable through the injector port 116, the guiding apparatus 8 of the present invention greatly reduces the risks to the operators and nearby pedestrians.

As described herein, the guiding apparatus 8 provides numerous advantages over prior art devices. The preferred design of the enclosed frame 13 allows it to be easily pivoted to form a maximal opening for insertion of the cables or other elongated items. The frame 13 pivots open at either of two diagonally opposite corners to provide maximum flexibility. The guide rollers include a relatively soft surface that will not damage the surfaces of delicate cables. The design of the guiding apparatus allows the frame members to be manufactured as symmetrical parts, thereby saving manufacturing costs. Similarly, the design enables the use of lightweight molded materials which enhance the invention's portability and ease of use. The embodiments shown allow the guiding apparatus to be placed in any of numerous positions, which greatly adds to the flexibility and effectiveness of the guiding apparatus. In particular, multiple guiding apparatuses of various sizes can be mounted onto a truck track or rack so that multiple spools of cable can be guided without mutual interference.

An additional advantage of the invention is that a single guiding apparatus 8 with different attachments mounted to the roller frame assembly will change the application. The attachments can include the frame connecting web 32A, the frame track 35A, or any other attachments that can be connected to an appropriate mounting device. The enclosed frame 13 preferably is designed square with all four sides drilled and threaded for connecting and securing the many different attachments. Four separate attachments may be mounted to the roller frame at one time. The two frame members 10, 12 of the enclosed frame may also be interchanged by mixing and matching one half of the roller frame with another bearing different attachments. To quickly change from one configuration to another for a different work application, the quick release pins are removed and the frame members bearing the mounting attachments appropriate to the tasks at hand can be interchanged.

It is to be understood that even though numerous advantages of the present invention have been set forth in the foregoing description, the above disclosure is illustrative only. Changes may be made in detail and yet remain within the broad principles of the present invention. Therefore, the present invention is to be limited only by the appended claims.

I claim:

1. An apparatus for guiding an elongated item, comprising;

a first frame member having first and second legs coupled together substantially at a right angle to each other;

a second frame member having first and second legs coupled together substantially at a right angle to each other, the first leg of the second frame member being pivotally coupled to the first leg of the first frame member and the second leg of the second frame member having a connecting aperture;

a first hand-releasable pin coupled to the second leg of the first frame member and extending through the connecting aperture to hand-releasably latch the first frame member to the second frame member and thereby to form an enclosed frame enclosing a guiding aperture defined by the first and second legs of the first and second frame members; and a guiding surface supported by one of the frame members to guide the elongated item through the guiding aperture of the enclosed frame.

2. The apparatus of claim 1, further including a second hand-releasable pin coupled to the first leg of the second frame member to pivotally couple the first leg of the second frame member to the first leg of the first frame member, wherein the first leg of the first frame member includes a connecting aperture into which the second hand-releasable pin extends to hand-releasably connect the first frame member to the second frame member.

3. The apparatus of claim 1 wherein the guiding surface includes a first roller rotatably supported by the enclosed frame.

4. The apparatus of claim 3 wherein the first roller includes a plastic surface.

5. The apparatus of claim 3 wherein the enclosed frame includes a removable roller cap adapted to rotatably couple the first roller to the enclosed frame.

6. The apparatus of claim 3, further including a second roller parallel with the first roller, each roller having a guiding surface generally concave in shape.

7. The apparatus of claim 1, further including:

a frame coupling coupled to the enclosed frame; and a mount having a connection member means for connecting to the frame coupling and for maintaining the enclosed frame in any of a plurality of positions with respect to the mount.

8. The apparatus of claim 7 wherein the frame coupling includes first and second connection members, the first connection member being releasably coupled to the enclosed frame and the second connection member being for releasably coupling the frame coupling to the mount connection member means.

9. The apparatus of claim 7 wherein the mount includes an insulator clamp adapted to attach the mount to an insulator collar of a telephone or power pole.

10. The apparatus of claim 1, further comprising an elongated split tube attachment connected to one of the frame members, the split tube attachment extending transversely from a major diagonal of the enclosed frame and being adapted for insertion into a tube through which the elongated item is guided.

11. An apparatus for guiding an elongated item, comprising;

a first frame member having first and second legs angled with respect to each other;

a second frame member having first and second legs angled with respect to each other, the first legs being pivotally coupled together to pivotally connect the first frame member to the second frame member, and wherein the second legs are releasably coupled together, thereby forming a releasably enclosed frame enclosing a guiding aperture defined by the first and second legs of the first and second frame members; and a guide member, supported by one of the frame members, for guiding the elongated item through the guiding aperture of the enclosed frame.

12. The apparatus of claim 11 wherein the first frame member is pivotally coupled to the second frame member by a first pivot joint that includes:

a first aperture extending through the first leg of the second frame member;

a second aperture extending into the first leg of the first frame member; and a first releasable connection member releasably extending through the first aperture and into the second aperture.

13. The apparatus of claim 12 wherein the second frame member is releasably coupled to the first frame member by a second pivot joint that includes:

a first aperture extending through the second leg of the second frame member;

a second aperture extending into the second leg of the first frame member; and a first releasable connection member releasably extending through the first aperture and into the second aperture.

14. The apparatus of claim 11 wherein the apparatus includes a frame coupling having first and second connection members, the first connection member being releasably coupled to the releasably enclosed frame;

a mount having a mating coupling means for connecting the mount to the second connection member of the frame coupling wherein the mating coupling means includes means for positioning the releasably enclosed frame in any of a plurality of positions with respect to the mount.

15. The apparatus of claim 14 wherein the mount mating coupling means further includes a mount track, and the frame coupling includes a frame track slidably coupled to the mount track, to permit slidable positioning of the frame in one of a plurality of selected positions with respect to the mount.

16. The apparatus of claim 15, further including locking means for selectably restraining sliding motion of the frame track with respect to the mount track.

17. The apparatus of claim 14 wherein the mount includes a hand-releasable clamp adapted to clamp the mount to an object to which or from which the elongated item is being guided.

18. The apparatus of claim 14 wherein the mount includes an insulator clamp adapted to attach the mount to an insulator collar of a telephone or power pole.

19. The apparatus of claim 14 wherein the second connection member of the frame coupling includes a connection aperture and the mount mating coupling means includes:

a projecting mount web having:

a plurality of connection holes therethrough; and a mount outer surface; and a hand-releasable mount pin extending through a selected one of the connection holes and into the frame coupling connection aperture wherein the mount outer surface contacts the frame coupling to restrain rotation of the frame with respect to the mount.

20. The apparatus of claim 19 wherein the mount outer surface includes a plurality of planar surfaces, each planar surface being associated with one of the connection holes, each planar surface contacting the frame coupling to restrain rotation of the enclosed frame with respect to the mount when the mount pin extends through the connection hole associated with that planar surface.

21. The apparatus of claim 11, further comprising an elongated split tube attachment connected to one of the frame members, the split tube attachment extending transversely from a major diagonal of the enclosed frame and being adapted for insertion into a tube through which the elongated item is guided.

22. The apparatus of claim 11, further comprising a lubrication injector port extending through one of the frame members to allow lubricant to be injected onto the elongated item.

23. The apparatus of claim 11 wherein the first and second legs of the first frame member are coupled together substantially at a right angle and the first and second legs of the second frame member are coupled together substantially at a right angle such that the guiding aperture defined by the first and second frame members is substantially rectangular.

24. An apparatus for guiding an elongated item, comprising;

a frame having an enclosure defined by at least three legs, one of the legs supporting a guiding surface for guiding the elongated item through the frame enclosure;

a first frame coupling having first and second connection members, the first connection member releasably coupling the first frame coupling to a first leg of the frame legs, the second connection member being adapted to couple the first frame coupling to a first mount; and a second frame coupling having first and second connection members, the first connection member releasably coupling the second frame coupling to a second leg of the frame legs, the first connection members of the first and second frame couplings being structurally equivalent to each other such that each first connection member can be releasably coupled to either of the first and second legs of the frame, the second connection member being adapted to couple the second frame coupling to a second mount.

25. The apparatus of claim 24 wherein the second connection member of the first frame coupling includes a projecting frame connecting web having a frame connection aperture, and the invention further includes:

a mount having a mating coupling means for connecting the mount to the frame coupling and for maintaining the frame in any of a plurality of positions with respect to the mount, the mount mating coupling means includes a plurality of mount connection apertures; and a coupling member releasably extending through a selected one of the mount connection apertures into the frame connection aperture to selectively couple the frame to the mount.

26. The apparatus of claim 25 wherein the mount mating coupling means further includes a projecting mount web through which the mount connection holes extend, wherein the mount web has an outer surface, wherein the coupling member includes a hand-releasable pin, and wherein the mount web outer surface contacts the frame coupling to prevent rotation of the frame with respect to the mount.

27. The apparatus of claim 24 wherein the mount has a reference surface, wherein the mount mating coupling means includes a projection having a plurality of support surfaces wherein each is angled with respect to the others and wherein the frame coupling includes a mating surface to removably contact a selected one of the plurality of projection support surfaces to position the frame at a selected angle with respect to the mount reference surface.

28. The apparatus of claim 24 wherein the mount mating coupling mesas includes a mount track and the frame coupling includes a frame track slidably coupled to the mount track to slidably couple the mount to the frame coupling.

29. The apparatus of claim 28 wherein the mount track includes a frame locking means for hand-removably locking the mount track to the frame track to restrain sliding movement of the frame with respect to the mount.

30. The apparatus of claim 24 wherein the mount includes an insulator clamp adapted to attach the mount to an insulator collar of a telephone or power pole.

* * * * *